US006324980B1

(12) United States Patent
Bianchini

(10) Patent No.: US 6,324,980 B1
(45) Date of Patent: Dec. 4, 2001

(54) CONICAL PLUG FOR SEALING BLASTHOLES IN OPEN CUT MINING

(76) Inventor: Cesar Estevez Bianchini, Avenida 3G con Calle 60 N° 3F-56 Las Mercedes, Maracaibo, Edo. Zulia (VE)

( * ) Notice: Subject to any disclaimer, the term of this patent is extended or adjusted under 35 U.S.C. 154(b) by 0 days.

(21) Appl. No.: 09/281,853

(22) Filed: Mar. 31, 1999

(30) Foreign Application Priority Data

May 8, 1998 (VE) ..... 982

(51) Int. Cl.[7] ..... F42B 3/00
(52) U.S. Cl. ..... 102/333; 102/313
(58) Field of Search ..... 102/333, 313

(56) References Cited

U.S. PATENT DOCUMENTS

| | | | | |
|---|---|---|---|---|
| 2,047,774 | * | 7/1936 | Greene | 102/333 |
| 2,646,845 | * | 7/1953 | Schillinger | 102/333 X |
| 3,173,368 | * | 3/1965 | Griffith et al. | 102/333 |
| 3,608,491 | * | 9/1971 | Bates | 102/333 |
| 4,464,994 | * | 8/1984 | Porter | 102/333 |
| 4,754,705 | * | 7/1988 | Worsey | 102/333 |
| 5,247,886 | * | 9/1993 | Worsey | 102/333 X |

FOREIGN PATENT DOCUMENTS

| | | | | |
|---|---|---|---|---|
| 899715 | * | 5/1972 | (CA) | 102/333 |
| 744063 | * | 1/1944 | (DE) | 102/333 |
| 118852 | * | 5/1997 | (SE) | 102/333 |
| 1464032 | * | 3/1989 | (SU) | 102/333 |

OTHER PUBLICATIONS

Open Cut Blasting Situations—Mintech Cost Effective Blasting.

* cited by examiner

*Primary Examiner*—Peter A. Nelson
(74) *Attorney, Agent, or Firm*—Womble Carlyle Sandridge & Rice, PLLC

(57) ABSTRACT

A conical plug for sealing a blast hole in the earth is provided. The plug is made from a generally circular sheet of elastic material such as plastic or metal and can be folded and releasably locked with a trigger into a conical shape. When in its conical shape, the plug is lowered into a blast hole and, when in position, a release weight is slid down the lowering cable to impact and release the trigger. When the trigger is released, the plug expands and is wedged against the sides of the blast hole forming a plug capable of supporting debris in the upper portion of the blast hole.

4 Claims, 5 Drawing Sheets

CONICAL PLUG FOR SEALING BLASTHOLES IN OPEN CUT MINING

REFERENCE TO RELATED APPLICATION

The present application claims priority under 35 U.S.C Section 119 to previously filed Venezuelan patent application No. 982, filed May 8, 1998.

TECHINAL FIELD

The present invention relates to a plug for sealing the blasting wells in open cut mining. The device is a conical plug (100) to seal the well or blast hole (14) by a strong adherence of the base of the cone or disc (1) when it strikes the walls of the blast holes (14), based on elastic recovery of the circular sector shape of the cone when it is elastically 10 forced to form the cone (1). A trigger (7) maintains the form of the cone (1). When it is released the cone (1) suddenly tends to recover the planar form. The conical plug includes:

A cone (1)

Stabilizer (9)

Trigger (7)

Release weight (11)

The conical plug of the present invention is characterized by the non-flotability that makes it useful in dry wells or under water, and ease of recovery of the conical plug after improper positioning before blasting occurs.

BACKGROUND OF THE INVENTION

At present, in the market there are some devices for sealing and forming an air deck in a blasting well. These devices are basically plastic bags inflated by chemical foams or compressed gas. When the known devices are activated, the inflated bags seal the well. These devices are not recoverable in the event that the device is positioned improperly.

Other devices used to seal blast holes are typically pockets or containers supported from the surface of the well by rods or ropes and require strong pre-loaded springs for opening within the blast hole and for supporting the weight of the debris. The prior known devices are expensive.

SUMMARY OF THE INVENTION

The conical plug of the present invention is characterized by the following, which is more fully explained by the flier details that follow below:

It is completely mechanical.

Costs are reduced.

It can be manufactured using non-polluting chemicals or sprays (e.g. chemical foams or compressed gas).

It's components are not perishable, and it may be stored indefinitely without causing it to lose its characteristics.

It may work under any environmental condition, for example: extreme humidity or underground waters which may flood the well or blast hole.

Should the device be positioned improperly, it may be easily pulled back even after the trigger has been released, but prior to the filling of the well; therefore it may be re-used.

The adherence/grip force/wedging of the base of the cone to the walls of the blast hole or well increases with the weight of the debris.

DESCRIPTION OF THE INVENTION

In open cut mining, blasts are used to fracture the soil and to make the extraction of the materials and debris easier. For this purpose, wells or blast holes are drilled and filled partially with an explosive substance. An air deck should be left between the upper level of the explosive and the debris stemming to improve of the effect of the explosion efficiency. This air deck is achieved by placing a plug some distance above the explosive to prevent the debris from falling directly over the explosive.

Figure 1:
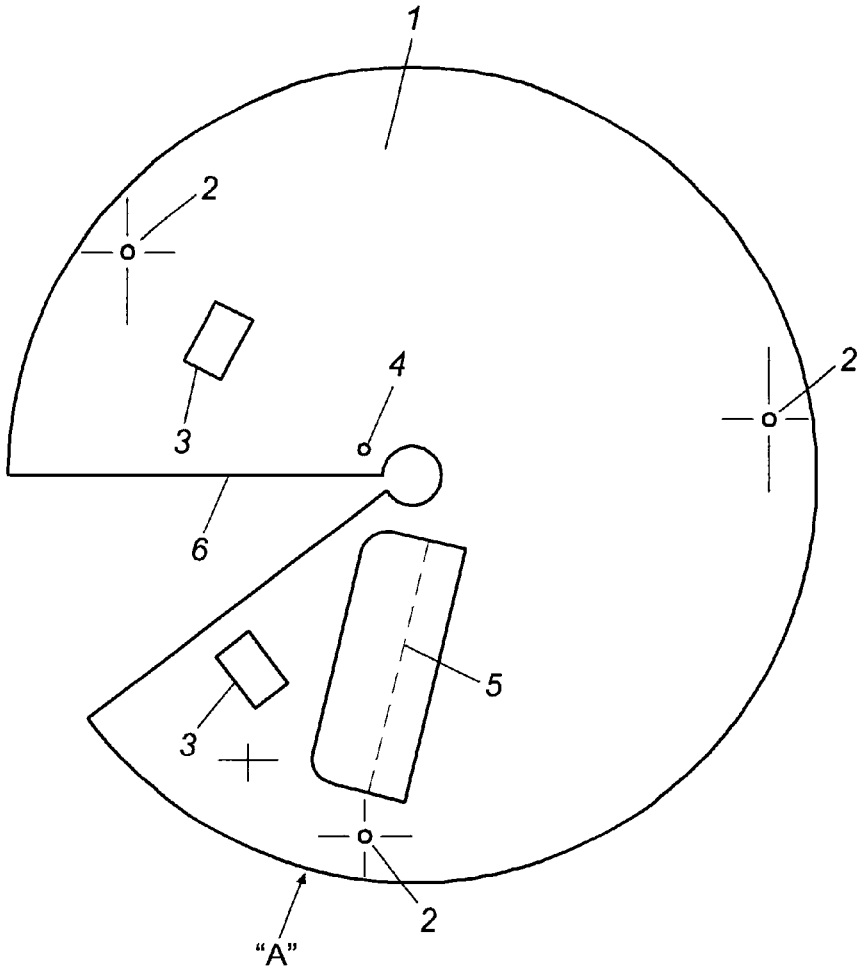
FIG. 1 is a top plan view of a conical plug in its pre-formed shape for sealing a blast hole in open cut mining that embodies the principles of the invention in a preferred form.
Figure 2:
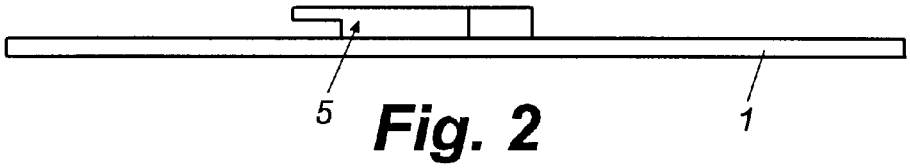
FIGS. 2 and 3 are side elevational views of the conical plug of FIG. 1.
Figure 3:
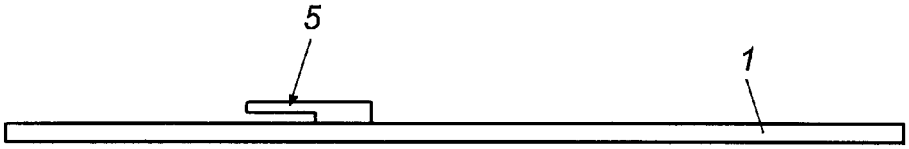
Figure 4:
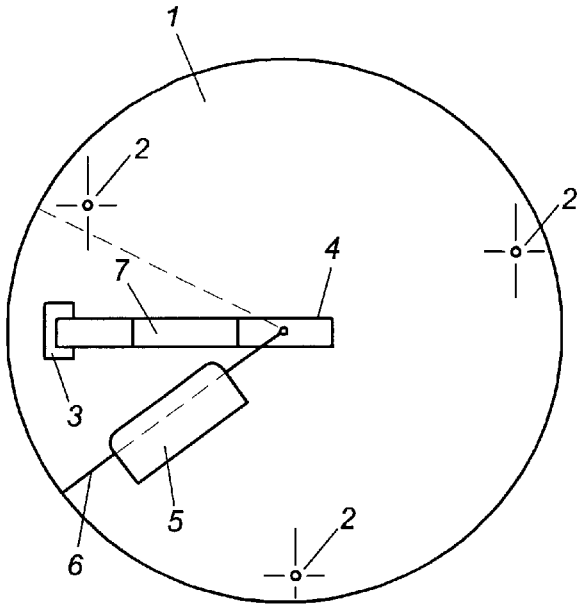
FIG. 4 is a top plan view of the conical plug of this invention in its folded configuration for lowering into a blast hole.

The following components form the conical plug of the present invention as can be seen particularly in FIGS. 1–5:

Cone: A circular sector of an elastic sheet (plastic or metal) forms a cone (1). It has a hook lug (5) to fix the overlap edge (6) and slots (3) to engage the trigger (7). FIG. 2 represents the elevation view of FIG. 1 and FIG. 3 represents the elevation view from "A".

Stabilizer: a stabilizer weight (9) and its supporting strings (10) extend from the base of the cone (1). At least one support string holder (2) is positioned along the periphery of the cone (1) to provide for attachment of the support strings (10) to the cone. As shown herein, three support strings (10) extend from the cone (1) to the stabilizer weight (9).

Trigger: The trigger (7) is typically configured as a hook shape and has a tenon (8). The tenon (8) goes through the slots (3) to secure the shape of the cone (1).

Support yarn: The support yarn or cable (13) extends from the apex of the cone (1) and typically has depth color marks to position the plug in the specified depth within the blast hole. Support yarn holder (4) is shown centrally positioned on the cone (1) to which the support yarn (13) attaches to the cone.

Release weight: A release weight (11) having a centered guide hole for attachment to the support yarn (13).

Figure 6:
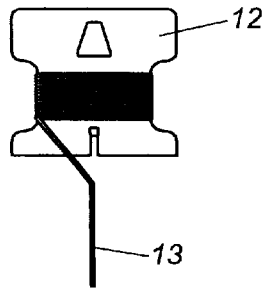
FIG. 6 illustrates a frame wrapped with cable for lowering the conical plug into a blast hole.
Figure 5:
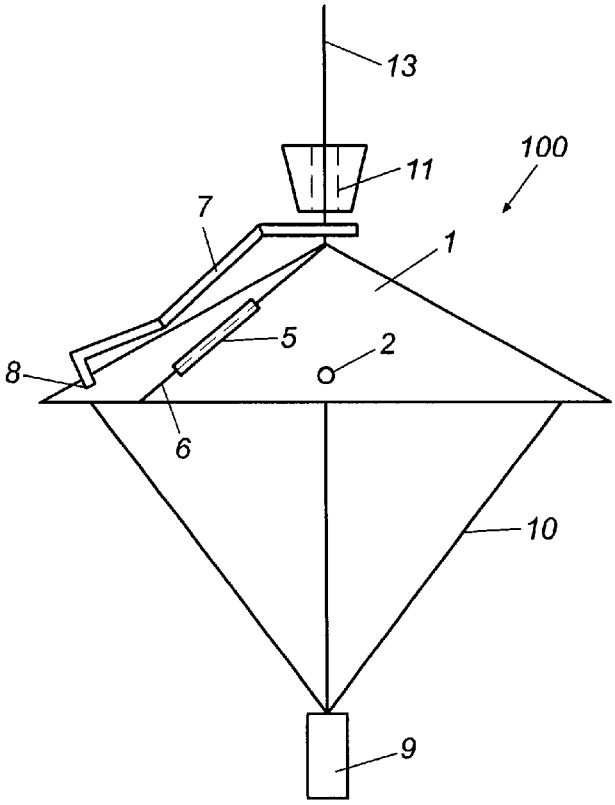
FIG. 5 is a side elevational view of the folded conical plug of FIG. 4.
Figure 7:
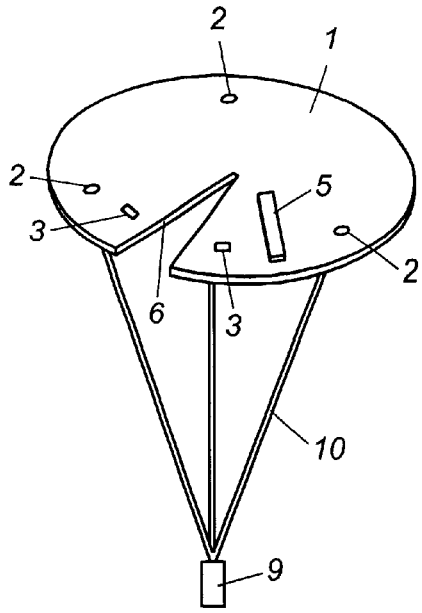
FIG. 7 is a perspective view of the conical plug in its unfolded flattened orientation.
Figure 8:
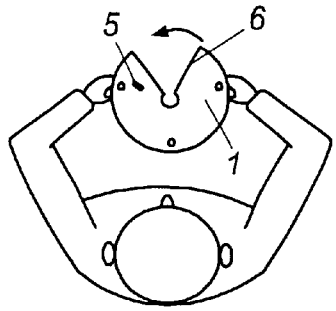
FIG. 8 illustrates the folding of the plug into a conical shape prior to its being lowered into a blast hole.
Figure 9:
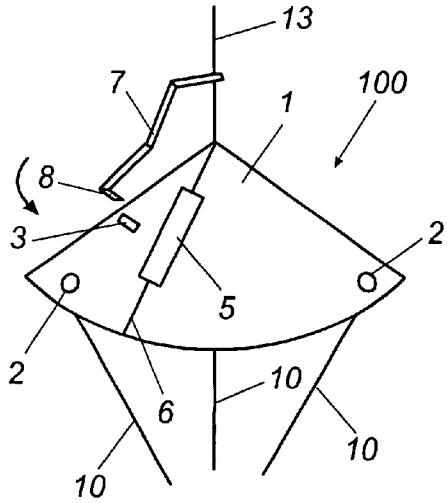
FIG. 9 illustrates the folded conical plug and insertion of the trigger that holds the plug in its conical configuration until it is time to release the trigger.
Figure 10:
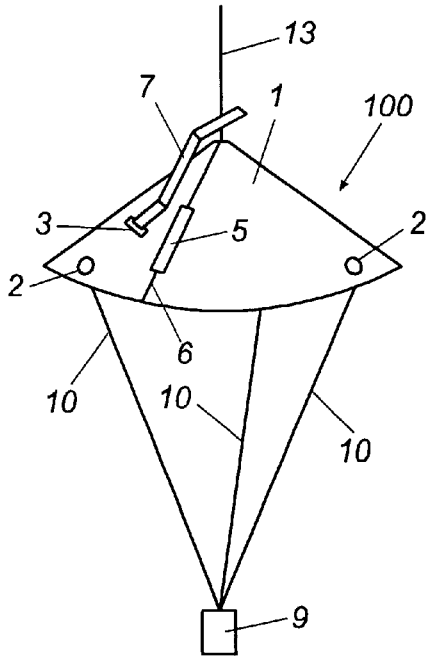
FIG. 10 illustrates the conical plug of this invention in its fully folded configuration with the trigger installed.
Figure 11:
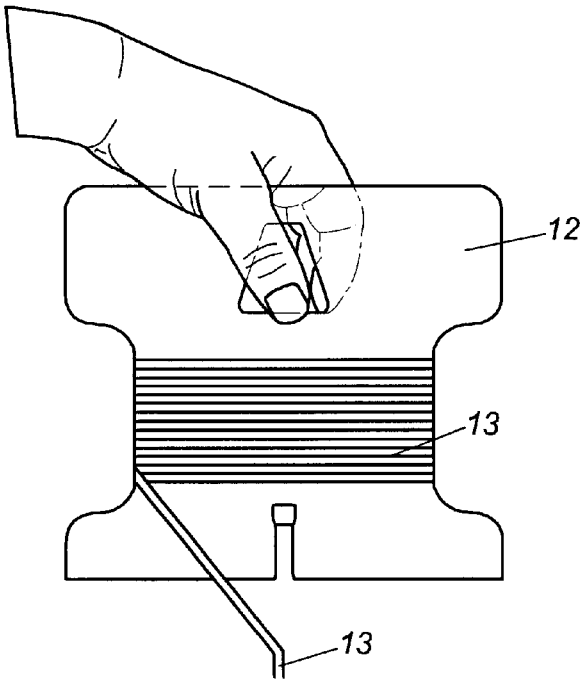
FIG. 11 illustrates the frame and cable used to lower the plug.

Yarn handle: A yarn handle or frame (12) is shown in FIG. 6, on which the sufficient length of support yarn (13) is wound.

The industrial application of the device of the present invention is in open cut mining improving the productivity and efficiency of the blasting, saving explosive and time, thereby reducing costs.

OPERATION PROCEDURE

See for instance, FIGS. 7 to 11:

A. —To use the conical plug of the present invention, first hold the disc (1) with the hands with the stabilizer weight (9) hanging down from the disc (1). See FIG. 7.

B. —Hold the disc (1) with the hands and force the circular sector to take the form of a cone placing the radial overlap edge (6) of the circular sector under the hook lug (5) until the two slots (3) coincide. See FIGS. 8 and 9.

C. —Hold with the left hand the overlap zone or section of the cone (1) while inserting the tenon (8) of the trigger (7) through the two slots (3). See FIGS. 9 and 10.

D. —Raise the conical plug (100) by the support yarn (13) to lower the plug into the blast hole (14). See FIGS. 10 and 12.

E. —Unwind the support yarn (13) from the yarn handle (12) and holding it with one hand, lower the conical plug (100) to the specified depth. The support yarn (13) has color marks to indicate the depths. See FIG. 11.

F. —Now holding the conical plug (100) by the support yarn (13), release the release weight (11), causing the base of the cone to expand to strike the walls of the blast hole. The support yarn (13) should be tensioned during the blast and until the debris stemming (17) has completed falling. (In the event the conical plug (100) is improperly placed or the position (depth) needs to be changed, the support yarn (13) may be pulled to recover the conical plug (100), taking it out from the blast hole (14).) Then repeat the same procedure from point A.

Figure 12:
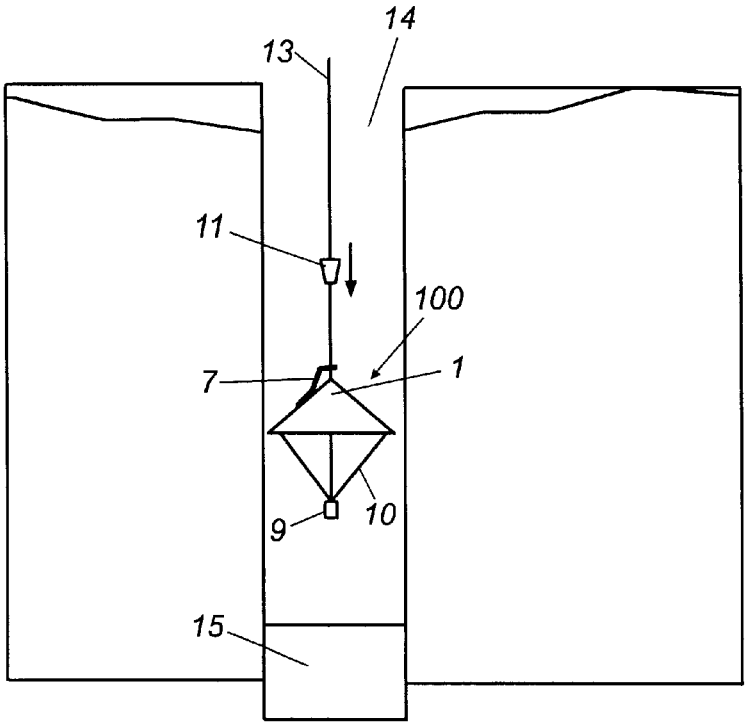
FIG. 12 illustrates a blast hole formed in the ground with the plug lowered into the hole and with the triggering weight sliding down the cable to release the trigger to spread the base of the cone of the plug.

FIG. 12 represents the device (conical plug) (100) in the specified depth and the release weight ( 1) being released and falling down toward the trigger (7) to engage the trigger. The tenon (8) is securing the conical shape. Notice that the diameter of the cone (1) is smaller than the blast hole diameter (14) in order to easily lower the conical plug (100) into the blast hole.

Figure 13:
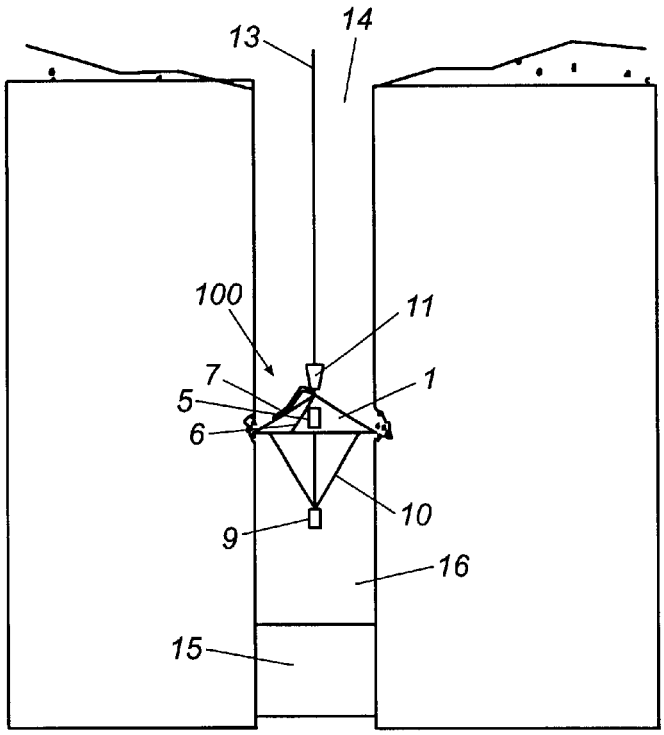
FIG. 13 illustrates the plug wedged against the walls of a blast hole after the trigger has been released.

FIG. 13 represents the conical plug (100) already triggered. The trigger (7) has been released by the impact of the release weight (11). The cone base (1) has increased its diameter and the cone base has wedged into the walls of the blast hole (14).

Figure 14:
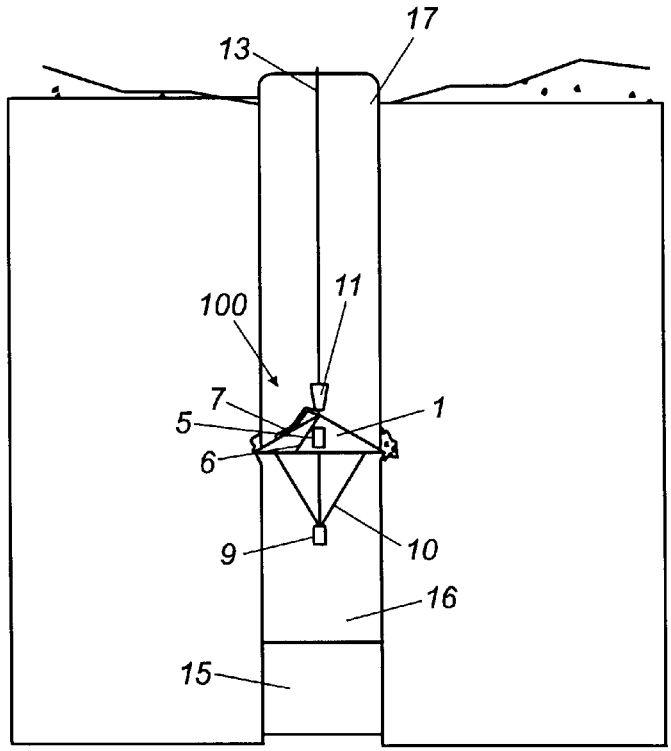
FIG. 14 illustrates the conical plug supporting debris in the top portion of the blast hole.

FIG. 14 represents the blast hole (14) already sealed with the conical plug (100), separating the air deck (16) and the debris stemming (17), which is stemmed or dammed by the conical plug. The weight of the debris stemming (17) over and lying on the apex of the conical plug (100) causes the diameter of the base of the cone (1) to increase, thereby improving the holding strength of the conical plug to the walls of the blast hole (14). In other words, the conical plug (100) is wedged into the walls of the blast hole (14).

What is claimed is:

1. A conical plug for sealing a blast hole comprising:

a cone further comprising a sheet of an elastic material, the sheet having a circular sector shape, the sheet being formed into a conical shape having a base and an apex, the conical shape being maintained smaller than the diameter of the hole by a trigger tenon arrangement while being lowered into the blast hole;

a stabilizer extending from the base of the cone; and the trigger positioned upon said cone to secure the conical shape when engaged, wherein release of the trigger increases the diameter of the base of the cone while continuing to maintain its conical shape, so that, when released, the base of the cone strikes the walls of the blast hole, the conical plug thereby receiving debris stemming at the apex of the cone, wherein the cone increases in diameter and wedges into the walls of the blast hole.

2. A conical plug for sealing a blast hole according to claim 1 wherein the stabilizer further comprises a weight positioned axially centralized to the base of the cone.

3. A conical plug for sealing a blast hole according to claim 1 further comprising: the cone having an overlap zone when the cone has been formed into the conical shape; and a hook lug on the cone, the hook lug securing the conical shape in the overlap zone.

4. A conical plug for sealing a blast hole according to claim 1 further comprising:

a cable extending from the apex of the cone; and a release weight attached to the cable in a way that allows the release weight to impact and release the trigger.

* * * * *